US010190344B2

(12) United States Patent
Reddmann

(10) Patent No.: US 10,190,344 B2
(45) Date of Patent: Jan. 29, 2019

(54) MOTOR VEHICLE DOOR

(71) Applicant: Kiekert AG, Heiligenhaus (DE)

(72) Inventor: Uwe Reddmann, Essen (DE)

(73) Assignee: Kiekert AG, Heiligenhaus (DE)

( * ) Notice: Subject to any disclaimer, the term of this patent is extended or adjusted under 35 U.S.C. 154(b) by 10 days.

(21) Appl. No.: 15/559,072

(22) PCT Filed: Mar. 15, 2016

(86) PCT No.: PCT/DE2016/100117
§ 371 (c)(1),
(2) Date: Sep. 18, 2017

(87) PCT Pub. No.: WO2016/146108
PCT Pub. Date: Sep. 22, 2016

(65) Prior Publication Data

US 2018/0073287 A1 Mar. 15, 2018

(30) Foreign Application Priority Data

Mar. 16, 2015 (DE) ..... 10 2015 103 830

(51) Int. Cl.
*B60J 5/00* (2006.01)
*E05C 17/20* (2006.01)
(Continued)

(52) U.S. Cl.
CPC ..... *E05C 17/203* (2013.01); *E05C 17/003* (2013.01); *E05F 15/627* (2015.01);
(Continued)

(58) Field of Classification Search
CPC ..... B60R 22/04; B60R 25/1003; B60R 3/02; Y10T 292/1047; E05Y 2900/531;
(Continued)

(56) References Cited

U.S. PATENT DOCUMENTS 3,202,414 A * 8/1965 Simmons ..... E05F 15/622 49/280
4,429,491 A * 2/1984 Bruns ..... E05F 15/53 49/340

(Continued)

FOREIGN PATENT DOCUMENTS

DE 41 30 782 A1 3/1993
DE 20 2005 020085 U1 5/2007

(Continued)

OTHER PUBLICATIONS

International Search Report and Written Opinion for corresponding Patent Application No. PCT/DE2016/100117 dated Sep. 6, 2016.

*Primary Examiner* — Kiran B Patel

(74) *Attorney, Agent, or Firm* — Renner, Otto, Boisselle & Sklar, LLP

(57) ABSTRACT

The invention relates to a motor vehicle door, in particular a handleless motor vehicle side door. The basic structure of said side door comprises a door leaf (1), a locking element (4, 5, 6), hinged to a motor vehicle body (2), for locking the door leaf (1) in predetermined angular positions in relation to the motor vehicle body (2), and at least one actuator (10, 11) acting upon the door leaf (1). Said actuator (10, 11) causes the door leaf (1) to open to an at least ajar position in relation to the motor vehicle body (2). According to the invention, the actuator (10, 11) is connected to the locking element (4, 5, 6) and directly drives the latter to adjust the door leaf (1).

10 Claims, 5 Drawing Sheets

Figure 1:
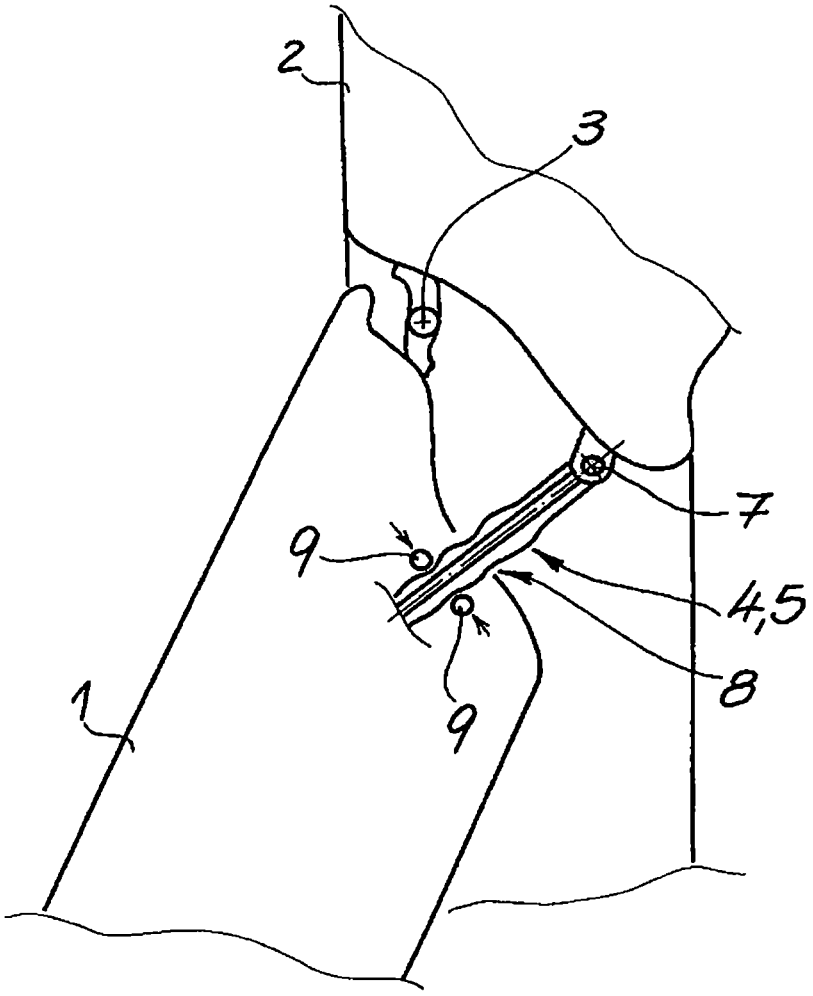

(51) Int. Cl.

| | |
|---|---|
| ***E05C 17/00*** | (2006.01) |
| ***E05F 15/627*** | (2015.01) |
| *E05B 81/06* | (2014.01) |
| *E05B 81/40* | (2014.01) |
| *E05F 15/622* | (2015.01) |

(52) U.S. Cl.
CPC ..... *E05B 81/06* (2013.01); *E05B 81/40* (2013.01); *E05F 15/622* (2015.01); *E05Y 2201/426* (2013.01); *E05Y 2201/43* (2013.01); *E05Y 2900/531* (2013.01)

(58) Field of Classification Search
CPC ..... E05Y 2201/22; E05Y 2201/434; Y10S 292/31; Y10S 292/46
USPC ..... 296/146.4
See application file for complete search history.

(56) References Cited

U.S. PATENT DOCUMENTS

| | | | | |
|---|---|---|---|---|
| 4,679,451 | A * | 7/1987 | Nakamura | F16H 25/20 74/606 R |
| 5,910,692 | A * | 6/1999 | Saeda | F16H 25/20 310/13 |
| 6,009,668 | A * | 1/2000 | Reddy | E05C 3/34 49/280 |
| 6,107,759 | A * | 8/2000 | Miller | B60S 1/18 318/14 |
| 6,659,515 | B2 * | 12/2003 | Raymond | E05B 81/20 292/201 |
| 9,322,204 | B2 * | 4/2016 | Suzuki | E05F 15/611 |
| 9,650,826 | B2 * | 5/2017 | Potter | E05F 15/614 |
| 2005/0160846 | A1 * | 7/2005 | Chiang | F16H 25/20 74/89.35 |
| 2007/0120378 | A1 * | 5/2007 | Hayakawa | E05B 81/20 292/216 |
| 2009/0051192 | A1 * | 2/2009 | Ewing | E05F 15/622 296/146.2 |
| 2010/0282009 | A1 * | 11/2010 | Knudsen | F16H 25/20 74/89.37 |
| 2011/0204675 | A1 * | 8/2011 | Sonnek | E05B 83/01 296/146.4 |
| 2011/0266080 | A1 | 11/2011 | Schmitt | |
| 2012/0000304 | A1 * | 1/2012 | Hamminga | E05F 15/622 74/89.23 |
| 2012/0212006 | A1 * | 8/2012 | Coldre | B60J 5/0473 296/146.4 |
| 2012/0245800 | A1 * | 9/2012 | Koberstaedt | B60J 5/101 701/49 |
| 2012/0291354 | A1 * | 11/2012 | Giannis | E05F 15/63 49/324 |
| 2013/0031747 | A1 * | 2/2013 | Gobart | E05D 11/1028 16/82 |
| 2013/0074412 | A1 * | 3/2013 | Wellborn | E05C 17/203 49/381 |
| 2014/0150581 | A1 * | 6/2014 | Scheuring | F16H 25/2015 74/89.38 |
| 2014/0352216 | A1 * | 12/2014 | Kapustnyk | E05B 81/06 49/31 |
| 2015/0059250 | A1 * | 3/2015 | Miu | E05F 15/611 49/349 |
| 2015/0283886 | A1 * | 10/2015 | Nania | E05F 15/73 296/146.4 |

FOREIGN PATENT DOCUMENTS

| | | | |
|---|---|---|---|
| DE | 10 2009 006948 | A1 | 8/2010 |
| DE | 10 2013 202 801 | A1 | 8/2014 |
| EP | 2 733 292 | A2 | 5/2014 |
| FR | 1 494 135 | A | 9/1967 |
| FR | 2 860 261 | A1 | 4/2005 |

* cited by examiner 7
10
11
4
5
6
18
21
13
22
20
12
1
19
17
25
24
23
16
15
14

MOTOR VEHICLE DOOR

The invention relates to a motor vehicle door, in particular a handleless motor vehicle lateral door, with a door panel, furthermore with a locking component connected to a motor vehicle chassis to immobilize the door panel in pre-determined angular positions with respect to the motor vehicle chassis and with at least one actuator working on the door panel, which causes at least a chinkwise opening of the door panel with respect to the motor vehicle chassis.

Motor vehicle doors are consistently equipped with locking components to immobilize the door panel in pre-determined angular positions with respect to the motor vehicle chassis. To this end, the locking component is connected to the motor vehicle chassis and usually in such a way that its fulcrum is outside of the pivoting axis of the door panel specified by hinge axes. The locking component generally protrudes beyond an opening on a lateral edge inside the door panel. Due to its excentric linkage on the motor vehicle chassis in relation to the hinge axes, the locking component accomplishes extension and retraction movements relative to the door panel when the door panel moves.

Normally, such locking components possess a locking arm or ratchet arm with several ratchet recesses. Locking instruments attached to the door panel can be plunged into the ratchet recesses. The pre-determined angular positions of the door panel can thus be executed with respect to the motor vehicle chassis. Such a procedure is adequately known, to which reference is made to DE 41 30 782 A1 only as an example.

In particular in the case of handleless motor vehicle lateral doors it is necessary to open these or the pertaining door panel at least chinkwise to open the relevant motor vehicle lateral door. This generally means an opening gap in the region of 100 mm to 200 mm with respect to the motor vehicle chassis. Thereby an operator can reach into the gap behind the door panel and open this completely. The at least one actuator working on the door panel ensures the at least chinkwise opening of the door panel with respect to the motor vehicle chassis.

In the class-specific state of the art according to DE 10 2013 202 801 A1, a device for activating a motor vehicle door with a locking function is described. The device possesses an actuator which can be affixed to the motor vehicle door and a pivoting lever pivotable around an actuator axis by the actuator. Furthermore, an actuating arm or a locking component to immobilize the motor vehicle door is provided for in pre-determined angular positions with respect to the motor vehicle chassis. In the known theory it is proceeded in such a way that the actuating arm or the locking component is pivotably connected to the pivoting lever which can be acted on by the actuator.

This should enable the retrofitting of optionally conventional equipment or the described equipment with the least possible expense. As a consequence hereof, a kinematically relatively elaborate design is executed because the actuator works on the pivoting lever which can be pivoted around the actuator axis which, in turn, is pivotably connected with the actuating arm or locking component. This is where the invention starts from.

The invention is based on the technical problem of further developing a motor vehicle door in such a way that an at least chinkwise opening of the door panel is caused with respect to the motor vehicle chassis in a constructionally simple manner.

In order to solve this technical problem is a class-specific motor vehicle door and in particular a handleless motor vehicle lateral door within the scope of the invention, characterized in that the actuator working on the door panel is connected to the locking component and drives this directly to adjust the door panel.

Within the scope of the invention, the actuator works for the at least chinkwise opening of the door panel, i.e. directly on the locking component. This means that any intermediate elements, as compulsorily required by the class-specific state of the art according to DE 10 2013 202 801 A1 in the shape of the pivoting lever, are explicitly prevented. This initially thus reduces the constructional effort. Furthermore, the invention is based on the realization that the actuator connected to the locking component drives this and can also drive it directly and to adjust the door panel in such a way that at least the chinkwise opening of the door panel is attained. i.e. the actuating movements of the locking component caused with the aid of the actuator are consistently sufficient to open the door panel at least chinkwise so that an operator can reach into the gap and can reach behind the door panel to open it completely.

Naturally, it is also within the scope of the invention if the actuator connected to the locking component drives it directly to adjust the door panel and not only ensures a chinkwise opening of the door panel, but in principle can open the door panel completely and close it, if applicable. The locking component itself may transmit this actuating movement caused by the actuator via the aforementioned locking instruments to the door panel. In fact, the movement of the locking component initiated with the aid of the actuator corresponds to it being "lengthened" so to speak or the distance between one end of the locking component and the joint for connection of the locking component to the motor vehicle chassis being increased at the other end. As a consequence hereof, the door panel is moved outwards for the at least chinkwise opening.

Instead of with the locking instruments, the locking component can also interact with a door panel-side stop. For this purpose, the locking component preferably has a counterstop engaging on the relevant door panel-side stop and a ratchet arm to interact with the aforementioned locking instruments on the door panel. Furthermore, the locking component advantageously has an adjusting rod.

In fact, the actuator is usually formed as a linear actuator. It is thus regularly proceeded in such a way that the adjusting rod of the locking component is acted on by an adjusting nut connected to the actuator for linear adjustment. The actuator therefore ensures that the adjusting nut rotates. As a consequence hereof, the adjusting rod plunged into the adjusting nut executes relevant linear movements. The same applies to the locking component overall. These linear movements of the locking component are transmitted to the door panel to open it by means of the door panel-side stop.

In an especially preferred exemplary embodiment, the motor vehicle door according to the invention possesses a drive for the door panel in addition to the actuator. It is thus generally proceeded in such a way that the actuator ensures the chinkwise opening of the door panel with respect to the motor vehicle chassis. In contrast, the drive then causes complete opening/closure of the door panel with respect to the motor vehicle chassis. i.e. the drive works independently of the actuator in principle. The drive can open the door panel completely or also close the door panel completely. Also, both complete openings and closures of the door panel with respect to the motor vehicle chassis with the aid of the drive are possible and are included in the scope of the invention.

It has proven itself if the drive works via the stop on the door panel on the locking component. In fact, it is thus proceeded in such a way that the drive interacts with the counterstop on the locking component by means of the stop on the door panel. The stop on the door panel is advantageously formed in an adjustable manner.

In fact, the relevant stop can be two drive disks which can be moved relatively to one another. Both drive disks can also be connected via springs.

One drive disk is usually configured as a first drive disk interacting with the locking component. In contrast, the other drive disk is a second drive disk connected to the drive. As both drive disks are connected by spring force and are also configured so that they can be moved relatively to one another, disconnection also occurs from both the actuator and the drive. Due to the relative movability of the two drive disks and consequently the adjustable or flexible configuration of the stop on the door panel so to speak, the actuator and the drive do not engage rigidly on the stop, but are rather disconnected and move relative to one another.

Thus, any play during movement of the drive can also be offset as play during activation of the actuator. Thus, the drive and the actuator can be activated independently of one another and can be used for the desired movement of the door panel according to the invention. This all succeeds in a strikingly simple constructional manner and cost-effectively and functionally safe accordingly. Furthermore, the locking component is equipped with a further functionality because it moves with the aid of the actuator and is used for the adjustment of the door panel. These are the fundamental advantages.

Figure 2:
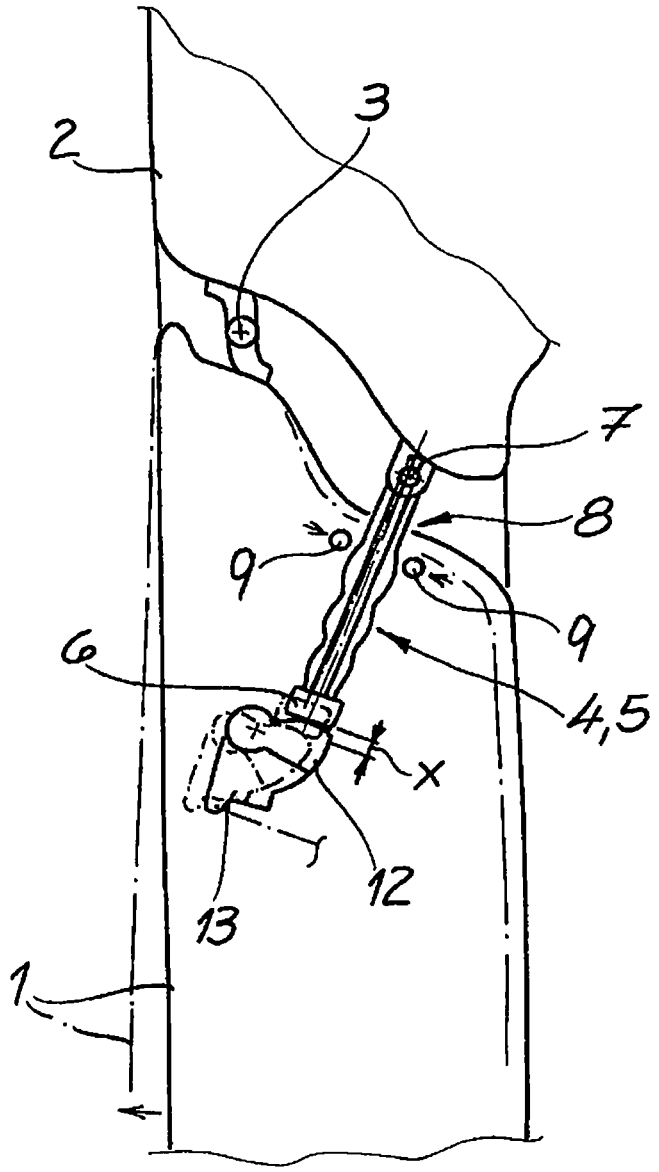
Figure 3:
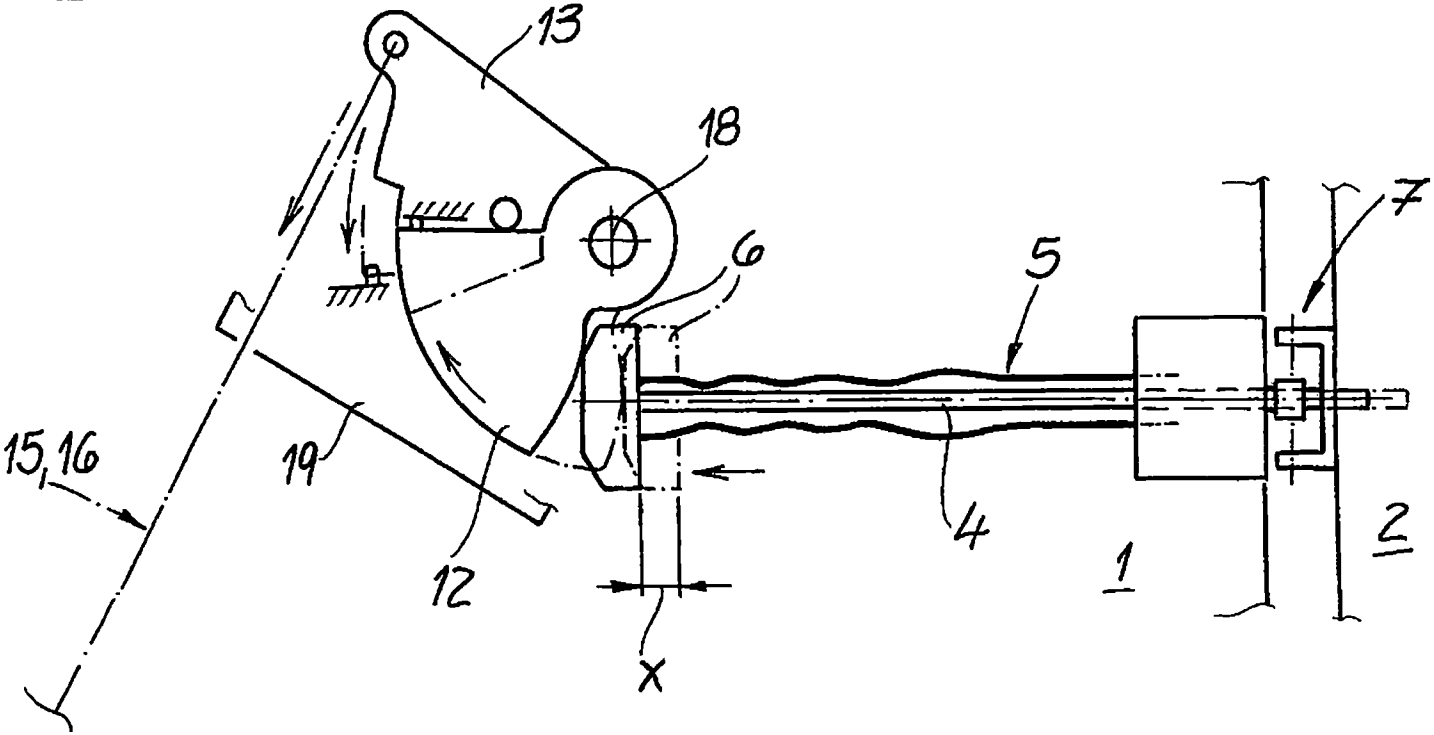
Figure 4:
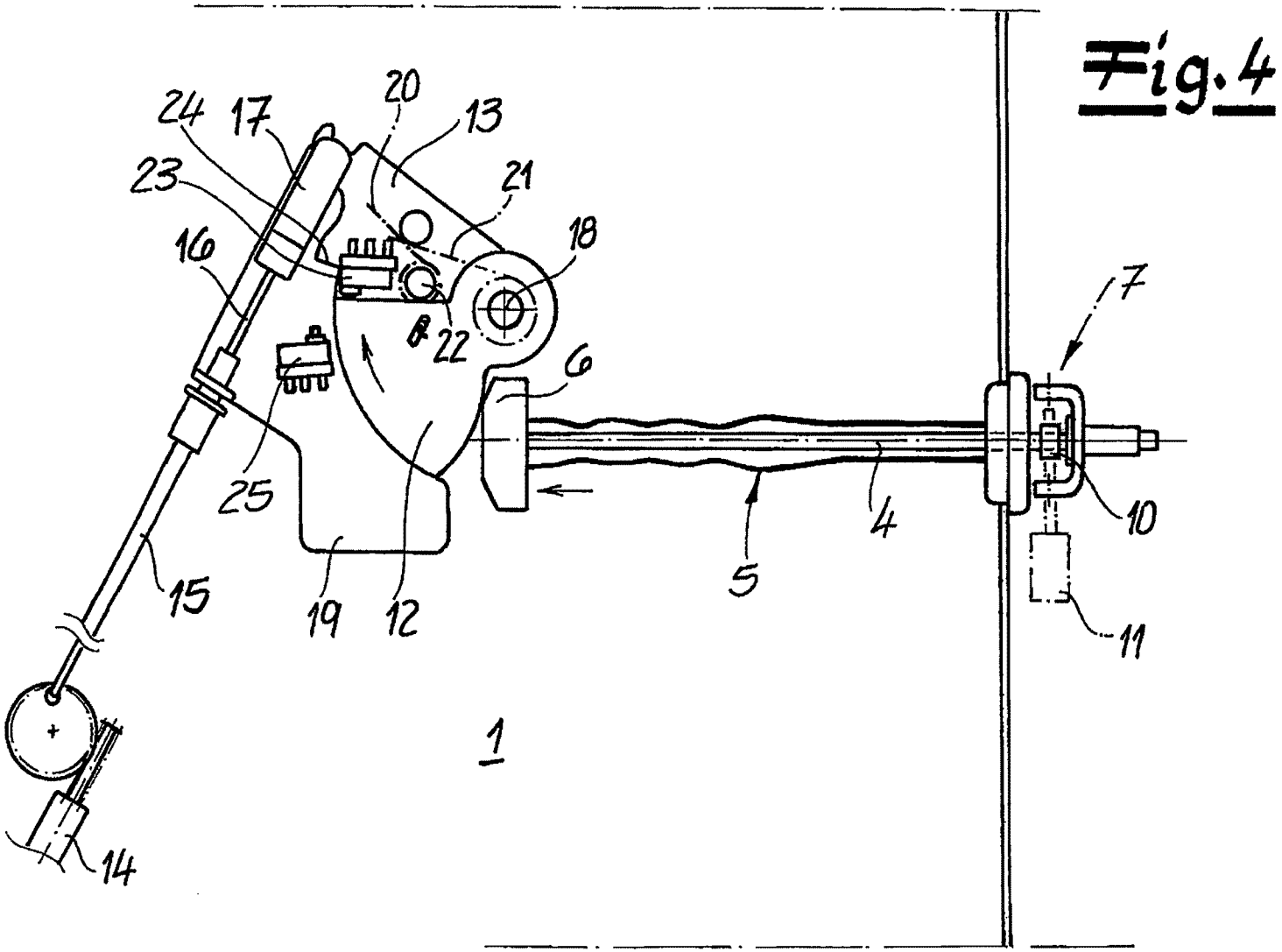
Figure 5:
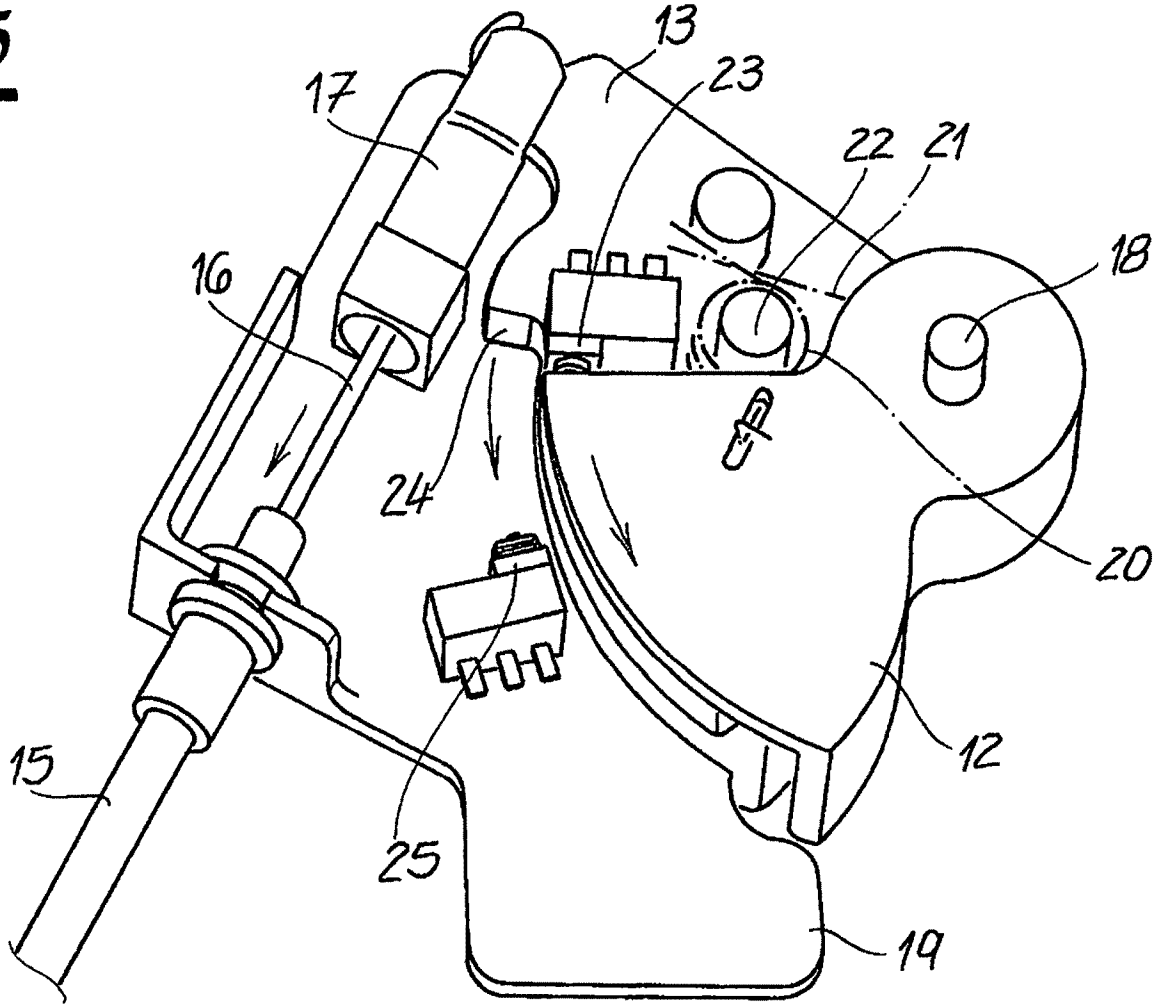

The invention is explained in further detail hereafter on the basis of a drawing which only constitutes an exemplary embodiment. The following are shown:

FIGS. 1 and 2 show a motor vehicle door according to the invention in the lengthwise cut diagrammatically in the opened state (cf. FIG. 1) and the closed state (cf. FIG. 2), FIG. 3 the motor vehicle door according to the invention in a diagrammatic overview and in a lateral view, FIG. 4 the lateral view according to FIG. 3 in the specific design and FIG. 5 a detail from FIG. 4, depicted in perspective.

The figures show a motor vehicle door, the door panel 1 of which is rotatably connected to a motor vehicle chassis 2 by means of one or several hinges 3. The hinges 3 or their hinge axes define a pivoting axis of the door panel 1. The depicted motor vehicle door is not restrictively a motor vehicle lateral door. Furthermore, the motor vehicle lateral door is configured without a handle; therefore it does not possess a door handle or a comparable handle for opening or closure. The relevant motor vehicle door must therefore be opened at least in a chinkwise manner with respect to the motor vehicle chassis 2 so that an operator can reach into the gap of the door panel 1 and open it completely.

In addition to the already described door panel 1 the motor vehicle door possesses a locking component 4, 5, 6, with the aid of which the door panel 1 can be immobilized in pre-determined angular positions with respect to the motor vehicle chassis 2. The locking component 4, 5, 6 is equipped with an adjusting rod 4 and a connected ratchet arm 5 in the exemplary embodiment. The end of the ratchet arm 5 is transferred into a counterstop 6, as illustrated in detail in FIG. 3.

The locking component 4, 5, 6, as shown by FIGS. 1 and 2, is rotatably and pivotably connected to the motor vehicle chassis 2 by means of a swivel joint 7. The swivel joint 7 defines a pivot point at a distance from the pivot axis of the door panel 1 specified by the hinge axes 3.

Consequently, the locking component 4, 5, 6 executes extension and retraction movements relative to the relevant door panel 1 due to the described excentric linkage to the motor vehicle chassis 2 when the door panel 1 moves. The locking component 4, 5, 6 protrudes into an opening 8 on a lateral edge of the door panel 1 (cf. FIGS. 1 and 2).

In order to immobilize the door panel 1 in the pre-determined angular positions with respect to the motor vehicle chassis 2 the ratchet arm 5 equipped with recesses interacts with only the locking instruments 9 inside the door panel depicted in FIGS. 1 and 2 lying opposite one another. The locking components 9 can be spring-loaded gliding or rolling bodies which press against the ratchet arm 5 with the force of their springs. As soon as the locking instruments 9 engage into a ratchet recess of the ratchet arm 5 of the locking component 4, 5, 6, the door panel 1 is immobilized in the pertaining angular position and unintentional movements of the door panel 1 are prevented.

In its fundamental structure, the motor vehicle door furthermore has at least an actuator 10, 11 working on the door panel 1 which is apparent in particular in FIG. 4. In the exemplary embodiment, the relevant actuator 10, 11 is arranged in the area of the swivel joint 7 which naturally is not compulsory and is only considered an example. The actuator 10, 11 in turn comprises an electromotor 11 and an adjusting nut 10 connected to the electromotor 11 which interacts with the adjusting rod 4 of the locking component 4, 5, 6.

In fact, the actuator 10, 11 is connected to the locking component 4, 5, 6 and drives the locking component 4, 5, 6 directly to adjust the door wing 1 and namely in a linear manner. This is achieved within the scope of the exemplary embodiment in such a way that the electromotor 11 starts the adjusting nut 10 rotating as a component of the actuator 10, 11. The adjusting rod 4 of the locking component 4, 5, 6 is plunged into the adjusting nut 10. The adjusting nut 10 and the adjusting rod 4 are equipped with threads corresponding to one another. Thus, rotations of the adjusting nut 10 lead to the adjusting rod 4 being moved backwards and forwards in a linear manner. The same also applies to the locking component 4, 5, 6 overall.

An outward movement of the door panel 1 is diagrammatically depicted in FIG. 3 with the aid of the locking component 4, 5, 6. The dot dashed position of the locking component 4, 5, 6 corresponds to the starting position; in contrast, the solid illustration marks the end of the adjustment path X of the locking component 4, 5, 6. i.e. for the outward movement of the door panel 1 the locking component 4, 5, 6 is moved to the left in the illustration according to FIG. 3, as shown by a relevant arrow. Naturally, the locking component 4, 5, 6 can also execute a countermovement for retraction which is not illustrated in FIG. 3, however.

As a consequence of the outward movement according to FIG. 3, the actuator 10, 11 which directly drives the locking component 4, 5, 6, i.e. manages without interposed transmission elements or similar, an at least chinkwise opening of the door panel 1. This chinkwise opening of the door panel 1 typically corresponds to a gap of the dimension of 100 mm to 200 mm with respect to the motor vehicle chassis 2, so that an operator can reach behind the door panel 1 in this gap in order to completely open it.

The actuator 10, 11 formed as a linear actuator therefore ensures overall that with the aid of the locking component 4, 5, 6 and its front-sided counterstop 6 a corresponding stop 12, 13 on the door panel 1 is also moved to the left in the illustration according to FIG. 3. As the stop 12, 13 is connected to the door panel 1, the described relocation of the locking component 4, 5, 6 leads to the counterstop 6 executing the adjustment path x illustrated in FIG. 3 and distancing itself from the swivel joint 7 by this amount. The direct consequence of this is that the door panel 1 is opened at least chinkwise with respect to the motor vehicle chassis 2.

As already explained, for this purpose the locking component 4, 5, 6 possesses 15 the end adjusting rod 4, which interacts with the adjusting nut 10 of the actuator 10, 11. i.e. the adjusting rod 4 is acted on by the adjusting nut 10 of the actuator 10, 11 for the linear adjustment of the locking component 4, 5, 6. In this process, the locking component 4, 5, 6 and the counterstop 6 is relocated to the left by the path amount x or the adjustment in the illustrated example according to FIG. 3. As the counterstop 6 interacts with door panel-side stop 12, 13 and this is also adjusted to the left in the illustration according to FIG. 3, the door panel 1 is as a result at least partially moved outwards or experiences the described chinkwise opening.

In the exemplary embodiment and according to a preferred execution form, a drive 14, 15, 16, 17 is also executed in addition to the already described actuator 10, 11. The drive 14, 15, 16, 17 is also dispensable in principle because the actuator 10, 11 can also drive the locking component 4, 5, 6 in theory in such a way that the locking component 4, 5, 6 completely opens the door panel 1 if necessary and closes it if applicable.

Within the scope of the exemplary embodiment, however, the configuration is such that the actuator 10, 11 ensures the chinkwise opening of the door panel 1 with respect to the motor vehicle chassis 2. In contrast, the drive 14, 15, 16 causes complete opening/closure of the door panel 1 with respect to the motor vehicle chassis 2. i.e. with the aid of the drive 14, 15, 16, 17 the initially chinkwise opened door panel 1 can initially be completely opened. Complete closure of the door panel 1 or both is also possible and is encompassed by the invention.

For this purpose, the drive 14, 15, 16, 17 works by means of the stop 12, 13 on the door panel 1 on the locking component 4, 5, 6. In fact, the drive 14, 15, 16 interacts by means of the stop 12, 13 with the counterstop 6 on the locking component 4, 5, 6 (cf. FIG. 3).

It is apparent that the stop 12, 13 is adjustably formed on the door panel 1. This is apparent on the basis of a comparative observation of the specific configuration according to FIGS. 4 and 5. In fact, the stop 12, 13 has two drive disks 12, 13 which can be moved relative to one another. The first drive disk 12 interacts with the locking component 4, 5, 6, as explained in further detail hereafter. The other second drive disk 13 is formed as a second drive disk 13 connected to the drive 14, 15, 16, 17.

In fact, the drive 14, 15, 16, 17 initially comprises an electromotor 14 and a Bowden cable 15, 16 connected to the electromotor 14 or another transmission part 15, 16. With the aid of the electromotor 14 a core 16 of the Bowden cable 15, 16 can be moved backwards and forwards in a linear manner with respect to the pertaining shell 15, as shown by a double arrow in FIGS. 4 and 5. As a consequence hereof, the second drive disk 13 connected to the core 16 by means of an end connection piece 17 is pivoted with respect to an axis 18.

In fact, the axis 18 is formed by a swivel pin which is connected to a connection plate 19. The connection plate 19 is immobilized on the door panel 1. Both drive disks 12, 13 are now rotatably configured in respect of the connection plate 19 with respect to the axis 18. Thus, the summarily formed stop 12, 13 on the door panel 1 is adjustably configured by the two drive disks 12, 13. Furthermore, the two drive disks 12, 13 are still elastically connected via springs 20, 21 and can consequently move relative to one another.

It operates as follows. In order to open the door panel 1, which is handleless in the exemplary embodiment, of the described motor vehicle lateral door with respect to the motor vehicle chassis 2 at least chinkwise, the actuator 10, 11 is initially acted on. The actuator 10, 11 ensures that the locking component 4, 5, 6 is moved to the left in the illustration according to FIG. 3. As 15 consequence hereof the stop 12, 13 also moves by the amount x of the pertaining adjustment path depicted there.

Transferred to the specific exemplary embodiment according to FIGS. 4 and 5, this means that the counterstop 6 of the locking component 4, 5, 6 travels against the first drive disk 12 and pivots it in a clockwise direction with respect to the axis 18. In this process, the first drive disk 12 takes along the second drive disk 13 by means of the spring 21, so that the stop 12, 13 overall completes the adjustment path x as described. As at this time the drive 14, 15, 16, 17 is rigid so to speak, the relocation of the stop 12, 13 on the door panel 1 ensures, with the aid of the linearly moved locking component 4, 5, 6, that the door panel 1 executes the described at least chinkwise opening. In this process, the actuator 10, 11 acts on the first drive disk 12 until it meets a stop 22. At the same time, a sensor or switch 23 is hereby activated which switches the actuator 10, 11 off.

The signal of the sensor 23 or the switch 23 can now also be used to start the drive 14, 15, 16, 17. This process ensures that the core 16 of the Bowden cable 15 is retracted or moved to the left in the illustration according to FIG. 5. As a consequence hereof, the drive disk 13 connected to the drive 14, 15, 16, 17 executes an anti-clockwise direction movement with respect to the axis 18. As the first drive disk 12 is adjacent to the stop 22 of the second drive disk 13, this is transmitted against the clockwise direction movement of the second drive disk 13 onto the first drive disk 12.

As the first drive disk 12 is adjacent on the counterstop 6 of the locking component 4, 5, 6, this process corresponds to the drive 14, 15, 16, 17 or the drive movement initiated by it bracing the locking component 4, 5, 6 or working on the locking component 4, 5, 6.

By means of the common anti-clockwise direction movement of the two drive disks 12, 13 around the axis 18 with respect to the connection plate 19 the door panel 1 is completely opened. This process ends as soon as the second drive disk 13 reaches a further sensor or switch 25 with a nose 24. In its impingement, this ensures that the drive 14, 15, 16 is switched off.

The invention claimed is:

1. A handleless motor vehicle lateral door, with a door panel, furthermore with a locking component linked to a motor vehicle chassis to immobilize the door panel in pre-determined angular positions with respect to the motor vehicle chassis, and with at least an actuator working on the door panel, which causes at least a gap opening of the door panel in respect of the motor vehicle chassis, wherein the actuator is connected to the locking component and directly drives it for adjustment of the door panel.

2. The motor vehicle door according to claim 1, wherein the actuator is formed as a linear actuator.

3. The motor vehicle door according to claim 1, wherein the locking component has an adjusting rod which is acted on by an adjusting nut of the actuator for linear adjustment.

4. The motor vehicle door according to claim 1, wherein the locking component has a counterstop engaging on a door panel-side stop and a ratchet arm to interact with locking components on the door panel.

5. The motor vehicle door according to claim 1, wherein in addition to the actuator a drive is provided for the door panel.

6. The motor vehicle door according to claim 5, wherein the actuator ensures the gap opening of the door panel with respect to the motor vehicle chassis, while the drive causes complete opening/closure of the door panel with respect to the motor vehicle chassis.

7. The motor vehicle door according to claim 5, wherein the drive works on the counterstop on the locking component by means of the stop on the door panel.

8. The motor vehicle door according to claim 4, wherein the stop is adjustably formed on the door panel.

9. The motor vehicle door according to claim 4, wherein the stop comprises a first drive disk and a second drive disk which can be moved relative to one another.

10. The motor vehicle door according to claim 9, wherein in addition to the actuator a drive is provided for the door panel, and the first drive disk interacts with the locking component and the second drive disk is connected to the drive.

* * * * *